United States Patent [19]

Sonerud

[11] Patent Number: 4,485,570

[45] Date of Patent: Dec. 4, 1984

[54] APPARATUS FOR MOUNTING A DRILLING MACHINE ON AN EXCAVATOR BUCKET

[76] Inventor: John T. Sonerud, Vintervägen 30, S-824 00 Hudiksvall, Sweden

[21] Appl. No.: 501,029

[22] Filed: Jun. 6, 1983

[30] Foreign Application Priority Data

Jun. 21, 1982 [SE] Sweden ..... 8203847

[51] Int. Cl.[3] ..... E02F 3/96

[52] U.S. Cl. ..... 37/117.5; 37/DIG. 12; 172/253; 173/29; 173/162 R; 175/87; 267/137; 403/4; 414/912

[58] Field of Search ..... 37/117.5, DIG. 3, DIG. 12; 175/87, 315; 173/29, 46, 162 R; 403/3, 4, 42; 414/912, 724; 172/245, 247, 253, 254, 438; 267/137, 125

[56] References Cited

U.S. PATENT DOCUMENTS

| | | | |
|---|---|---|---|
| 2,517,980 | 8/1950 | Cornett | 173/29 X |
| 2,623,739 | 12/1952 | Thomas et al. | 414/724 |
| 2,712,932 | 7/1955 | Gould | 267/125 X |
| 2,969,844 | 1/1961 | Hamrick | 37/DIG. 3 |
| 3,090,983 | 5/1963 | Modrak et al. | 414/724 X |
| 4,087,010 | 5/1978 | Stormon | 37/117.5 X |
| 4,199,033 | 4/1980 | Van Gundy, Jr. | 37/117.5 X |
| 4,297,799 | 11/1981 | Sonerud | 37/117.5 X |

FOREIGN PATENT DOCUMENTS

| | | | |
|---|---|---|---|
| WO80/01393 | 7/1980 | PCT Int'l Appl. | 37/DIG. 3 |

*Primary Examiner*—Clifford D. Crowder
*Attorney, Agent, or Firm*—Paul & Paul

[57] ABSTRACT

A drilling machine includes a coupling means (19) for removably coupling the drilling machine (1) to the bucket of an excavator with the aid of gripping arms (20, 21). Between the drilling machine and coupling means there is a rubber member (9) taking up misalignment stresses and a gas spring (11, 12) taking up shock and compression stresses arising in conjunction with drilling.

13 Claims, 2 Drawing Figures

APPARATUS FOR MOUNTING A DRILLING MACHINE ON AN EXCAVATOR BUCKET

DESCRIPTION

1. Technical Field

The present invention relates to a drilling machine, more specifically a drilling machine intended for removably coupling to a machine for manoeuvring the drilling machine, e.g. an excavator.

2. Background Art

In digging and excavating work with excavators, there are often encountered hard earth, stones, rock and frozen ground (in wintertime), which require drilling and blasting to cope with them.

With the exception of large rock excavations where special drilling carriages are used, one is consigned to manual drilling with air or hydraulically driven hand drilling machines for handling minor obstructions. This work is heavy and injurious to health, due to the heavy vibrations propogated to the driller as well as the stone dust liberated during the process and inhaled by the driller during drilling.

DISCLOSURE OF INVENTION

It is an object of the present invention to provide a drilling machine which does not need to be served by a person especially delegated for the purpose, and which without manual assistance can be coupled to a machine, e.g. a bucket provided with gripping fingers and mounted on an excavator, for carrying out drilling by operating the excavator. The excavator can thus be utilized optionally for excavating or drilling, and when the excavator is utilized during drilling the person normally carrying out drilling and who is idle during excavating work may be appointed to other tasks.

It is also an object of the invention to provide a drilling machine which can be coupled to a machine operating it such that the drilling work can be executed in practically any direction at all.

It is a further object of the invention to provide a drilling machine which takes up the misalignment forces occurring during drilling as a result of the drilling machine being rigidly coupled to the operating machine, and also to take up the shock stresses occurring when putting down the drill on rock, on a stone or the like and further to even out the compression stresses the drill is subjected to during drilling.

A still further object is to provide a drilling machine connectable to an operating machine and which comprises a hand drilling machine modified with simple means and in a simple way. These objects are achieved by the invention having been given the characterizing features disclosed in the claims.

PREFERRED EMBODIMENT

Figure 1:
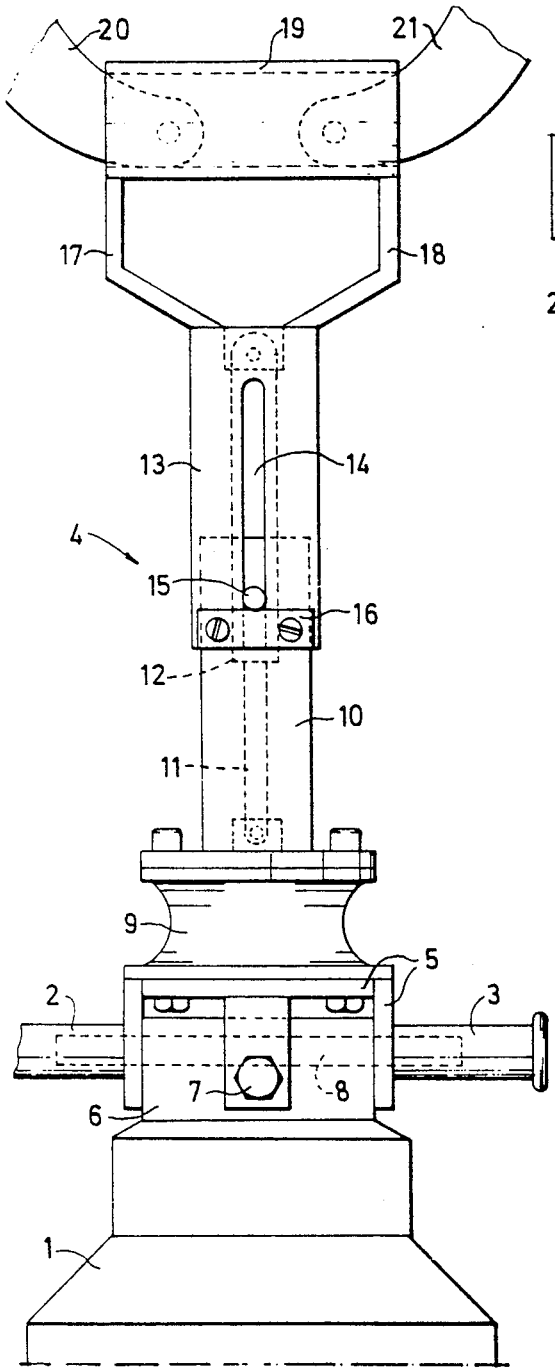
FIG. 1 is a schematic side view of a portion of a drilling machine in accordance with the invention, coupled to gripping means on the bucket of an excavator.
Figure 2:
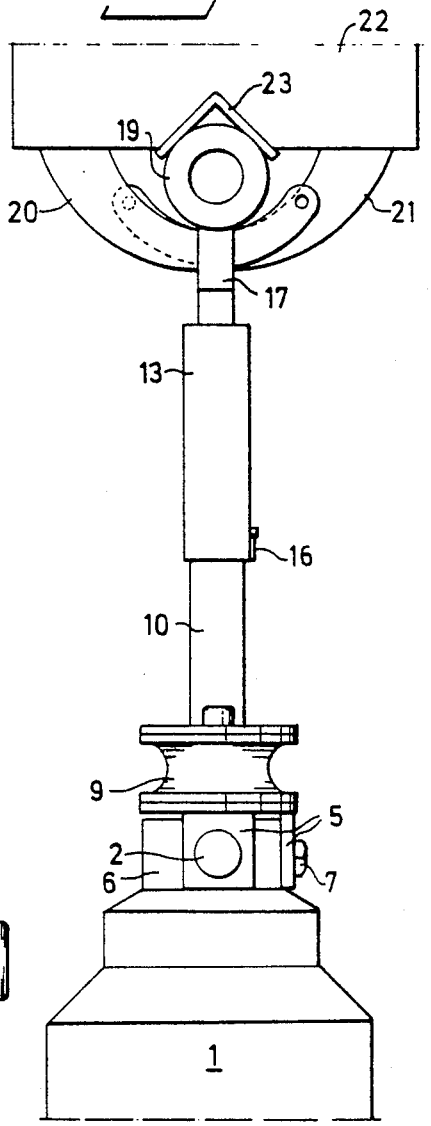
FIG. 2 is a schematic side view of the drilling machine in accordance with FIG. 1, coupled to the excavator bucket in a different angular attitude relative thereto.

The drilling machine in accordance with the invention comprises an ordinary pneumatic or hydraulic drilling machine 1, of which an upper portion is illustrated in FIGS. 1 and 2, and which is provided with two handles 2 and 3, with the aid of which the user operates the drilling machine during manual drilling, the inventive drilling machine also including a means 4 attached to the machine 1.

The means 4 includes a holder 5 partially surrounding a head 6 on the upper portion of the machine 1, and with the aid of which a bolt 7 and handles 2 and 3, which are threaded on a shaft 8 taken through the head 6 and removable therefrom, are removably attached to the head 6. A rubber block 9 is attached to the upper side of the holder 5. The upper portion of the rubber block 9 is attached to the lower portion of a tube 10, and to the lower portion of a piston rod 11 incorporated in a gas spring which also includes a cylinder 12. A tube 13, the interior cross section of which somewhat exceeds the exterior cross section of the tube 10 is telescopically displaceable on the tube 10 and is provided with a slot 14, in which thrusts a pin 15 attached to the tube 10. Withdrawal of the tube 10 from the tube 13 is restricted by the pin 15 when it contacts a locking plate 16, attached to the lower portion of the tube 13, and covering the open, lower portion of the slot 14. The pin 15 and slot 14 serve as guide means for preventing rotary movement between the tubes 10 and 13. Such movement is also inhibited by the tubes themselves, if they are made with a quadratic cross-section.

The upper portions of the cylinder 12 and tube 13 are attached to two members 17 and 18, the upper ends of which are attached to the ends of a circular tube 19.

When the drilling machine 1 and means 4 are to be used for vertical drilling, the gripping arms 20 and 21 are inserted in both ends of the tube 19 in the manner illustrated in FIG. 1, said gripping arms 20 and 21 being pivotably mounted on an excavator bucket 22 provided with a recess 23, e.g. of the kind described in my U.S. Pat. No. 4,297,799 and marketed under the registered trade name of GRAB JOHN. The drilling machine 1, 4 can lie on the ground during this procedure. The bucket is then lifted to a suitable height, during which the machine 1, 4 assumes a substantially vertical position, since the gripping arms are not clamped in the tube but only loosely inserted therein. The bucket is then lowered vertically until the drill touches the ground. The shock occurring thereby is taken up by the gas spring 11, 12, thus preventing the drill and the rest of the drilling machine from being subjected to damage. During drilling, the gas spring is compressed a predetermined distance and the drill will therefore be pressed into the drill hole with a predetermined force adjusted to the purpose, and substantially constant, this force being 60 kp for certain applications, even if the distance between the gripping arms 20, 21 and drilling machine 1 is not constant. This distance is however limited by the lengths of the gas spring 11, 12 and tubes 10, 13.

The lateral misalignment forces to which the drilling machine 1, 4 is subjected during drilling are taken up by the rubber block 9 which thus functions as a yielding joint.

When the drilling machine 1, 4 is to be used for horizontal drilling, the gripping arms 20, 21 grip round the tube 19 in the manner illustrated in FIG. 2, the bucket 22 then being lifted and taken toward the material to be drilled. The gas spring 11, 12 and block 9 take up the forces acting on the drilling machine 1, 4 in horizontal drilling as well, so that effective drilling without damage to the machine 1, 4 is achieved.

It should be understood that drilling can also be executed in directions other than those illustrated on the drawings, and the directions corrected during work by manoeuvring the bucket 22 and machine 1, 4 so as to alter the angle between the gripping arms 20, 21 and the tube 19 when the arms grip the tube as in FIG. 1, or as in FIG. 2.

It should also be understood that the invention is not limited to the illustrated and described embodiment, but can be modified within the scope of the inventive idea. For example, the rubber block and/or the gas spring 11, 12 can comprise any kind of elastic elements at all, such as one or more springs. The invention is thus only restricted by what is disclosed in the claims.

I claim:

1. A drilling machine comprising:

a. coupling means for removably coupling said drilling machine to a second machine for operating said drilling machine;

b. elastic means mounted between said drilling machine and said coupling means for taking up stresses between said second machine and said drilling machine occurring in conjunction with drilling;

c. said elastic means including first and second means, said first means comprising at least one resilient block for taking up misalignment stresses, said second means comprising a fluid spring for taking up shock and compression stresses.

2. A drilling machine according to claim 1 wherein the resilient block is a rubber block connected between said drilling machine and said fluid spring.

3. A drilling machine according to claim 1 wherein said fluid spring comprises a piston having one end connected to said resilient block and a cylinder having one end connected to said coupling means.

4. A drilling machine according to claim 3 wherein said fluid spring is a pneumatic spring.

5. A drilling machine according to claim 3 wherein first and second tubular members are provided which engage with each other in telescoping relation and wherein said piston is connected to one of said tubular members and said cylinder is connected to the other.

6. An apparatus for mounting a drilling machine on an excavator bucket having at least one swingable arm mounted thereon, said mounting apparatus comprising:

a. first coupling means detachably gripped by said swingable arm;

b. second coupling means detachably connected to said drilling machine;

c. first elastic means including a block of resilient material connected between said drilling machine and said excavator bucket for taking misalignment stresses occurring in conjunction with drilling;

d. second elastic means connected between said block of resilient material and said excavator bucket for taking up shock and compression stresses between said excavator bucket and said drilling machine occurring in conjunction with drilling;

e. said first and second elastic means being connected in alignment with each other and in alignment with the drilling direction of the drilling machine.

7. Apparatus according to claim 6 wherein said block of resilient material is a block of rubber.

8. Apparatus according to claim 7 wherein said second elastic means comprises a fluid spring.

9. Apparatus according to claim 8 wherein said second fluid spring comprises a piston and cylinder, said piston being connected to said rubber block and said cylinder being connected to said first coupling means.

10. Apparatus according to claim 9 wherein:

a. first and second telescoping tubular members are provided;

b. said piston and cylinder are mounted within said tubular members;

c. one end of said piston is connected to one of said telescoping tubular members, and d. one end of said cylinder is connected to the other of said telescoping tubular members.

11. Apparatus according to claim 10 wherein means are provided for inhibiting rotational movement of one of said tubular members relative to the other.

12. Apparatus according to claim 11 wherein said means for inhibiting rotational movement comprises an axial slot in one of said tubular members and a pin connected to the other of said tubular members and received within said slot.

13. An apparatus for mounting a drilling machine on an excavator bucket comprising:

a. first and second elastic means connected in alignment between said drilling machine and said excavator bucket for taking up misalignment, shock and compression stresses between the excavator bucket and the drilling machine in conjunction with drilling;

b. said connection including coupling means and remotely controlled gripping means for gripping said coupling means for detachably connecting the drilling machine in one of at least two possible positions.

* * * * *